US010971039B1

(12) United States Patent
Burns

(10) Patent No.: US 10,971,039 B1
(45) Date of Patent: Apr. 6, 2021

(54) DISPLAY SYSTEM FOR GUITAR SOUND HOLE

(71) Applicant: Eric Nathaniel Burns, Woodstock, GA (US)

(72) Inventor: Eric Nathaniel Burns, Woodstock, GA (US)

( * ) Notice: Subject to any disclaimer, the term of this patent is extended or adjusted under 35 U.S.C. 154(b) by 0 days.

(21) Appl. No.: 16/911,732

(22) Filed: Jun. 25, 2020

(51) Int. Cl.
*G10D 1/08* (2006.01)
*G09F 7/22* (2006.01)
*G09F 7/18* (2006.01)

(52) U.S. Cl.
CPC ..... *G09F 7/22* (2013.01); *G10D 1/08* (2013.01); *G09F 2007/1869* (2013.01)

(58) Field of Classification Search
CPC ..... G09F 7/22; G09F 2007/1869; G10D 1/08
See application file for complete search history.

(56) References Cited

U.S. PATENT DOCUMENTS

2003/0167901 A1* 9/2003 Lalonde ..... G10G 7/00 84/453

* cited by examiner

*Primary Examiner* — Kimberly R Lockett
(74) *Attorney, Agent, or Firm* — Richard Eldredge; Leavitt Eldredge Law Firm

(57) ABSTRACT

A display system for use in a sound hole of a guitar, the display system includes legs extending outwardly from a central point; a base connected to the legs; and a top plate rotationally connected to the base, the top plate having a weight such that the weight rotates to a bottom location during any manipulation of the base; the legs are to engage with the guitar to secure the display system within the sound hole.

6 Claims, 4 Drawing Sheets

DISPLAY SYSTEM FOR GUITAR SOUND HOLE

BACKGROUND

1. Field of the Invention

The present invention relates generally to guitar systems, and more specifically, to a display system for use within a sound hole of a guitar or other similar instrument, wherein the display system provides a means to display images, logos, or the like.

2. Description of Related Art

Guitar systems are well known in the art and are effective means of entertainment. For example, FIG. 1 depicts a conventional guitar 101, having a body 103 with a sound hole 105 and a neck 107 with strings 109. During use, a user will hold the body and strum or pluck the strings.

One of the problems commonly associated with guitar 101 is limited customization. For example, a user may not be able to incorporate logos or other images, particularly wherein the logo or other images are configured to remain upright at all times, such as during play (horizontal) and during storage (substantially vertical).

Accordingly, although great strides have been made in the area of guitars, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
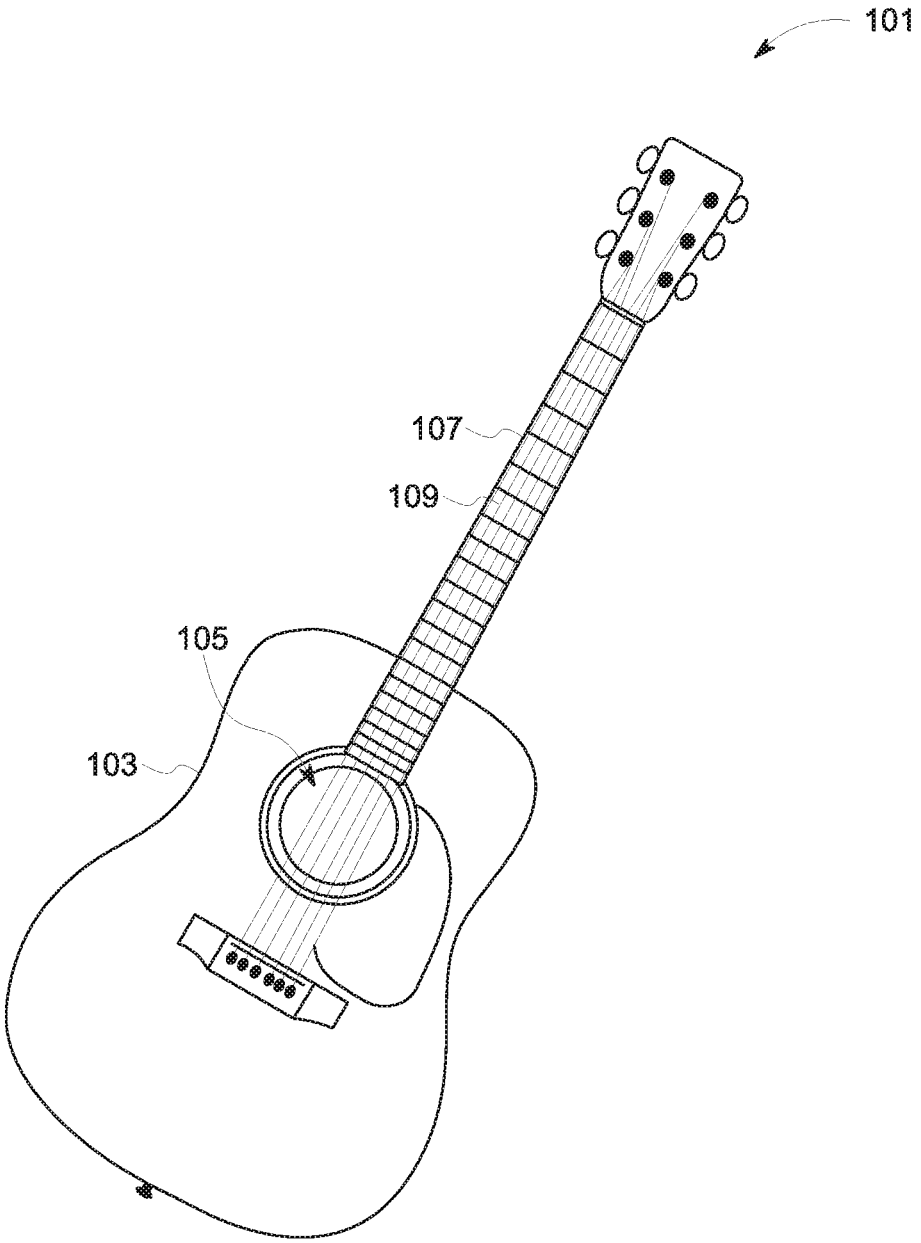
FIG. 1 (PRIOR ART)
FIG. 1 is a front view of a common guitar.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional guitar systems. Specifically, the present invention provides for a display apparatus to secure within the sound hole of a guitar and present an image in an upright position regardless of an orientation of the guitar. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
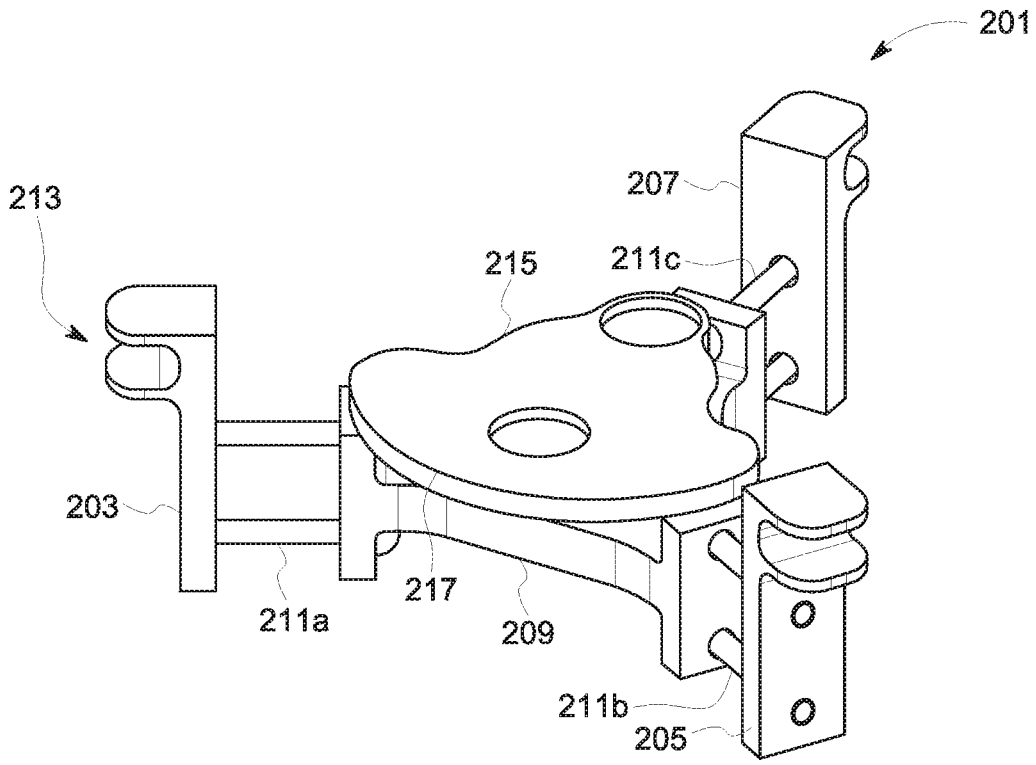
FIG. 2 is an isometric view of a display apparatus in accordance with a preferred embodiment of the present application.
Figure 3:
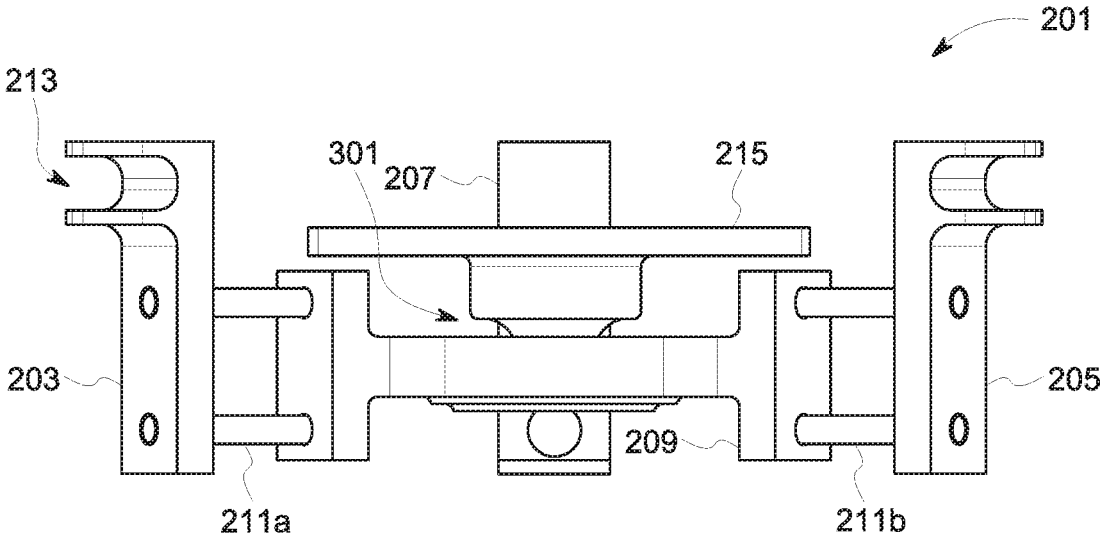
FIG. 3 is a side view of the apparatus of FIG. 2.
Figure 4:
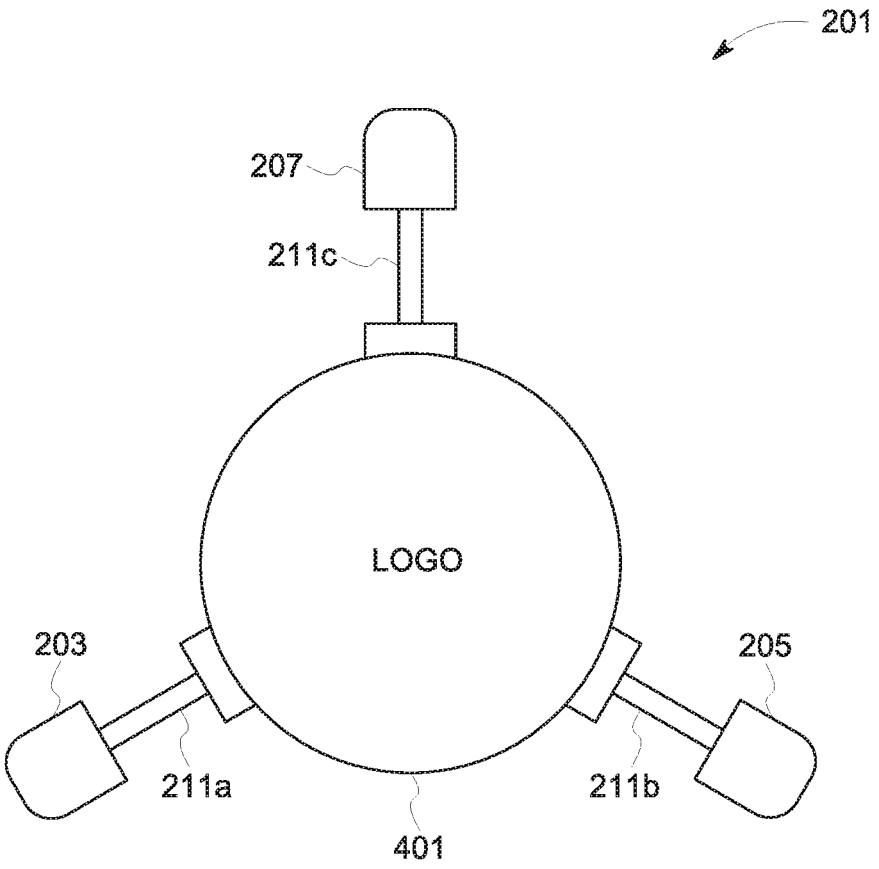
FIG. 4 is a top view of the apparatus of FIG. 2.

Referring now to the drawings wherein like reference characters identify corresponding or similar elements throughout the several views, FIGS. 2-4 depict various views of a display apparatus 201 in accordance with a preferred embodiment of the present application. It will be appreciated that system 201 overcomes one or more of the above-listed problems commonly associated with conventional guitar systems.

In the contemplated embodiment, apparatus 201 includes a plurality of legs 203, 205, 207 connected to a base 209. In some embodiments, the legs are spring loaded. As shown, in the preferred embodiment there are three leg assemblies, however it is contemplated that additional assemblies can be added. Further, it should be appreciated that the overall size and aesthetical appearance can be altered as desired based on manufacturing or functional considerations.

Figure 5:
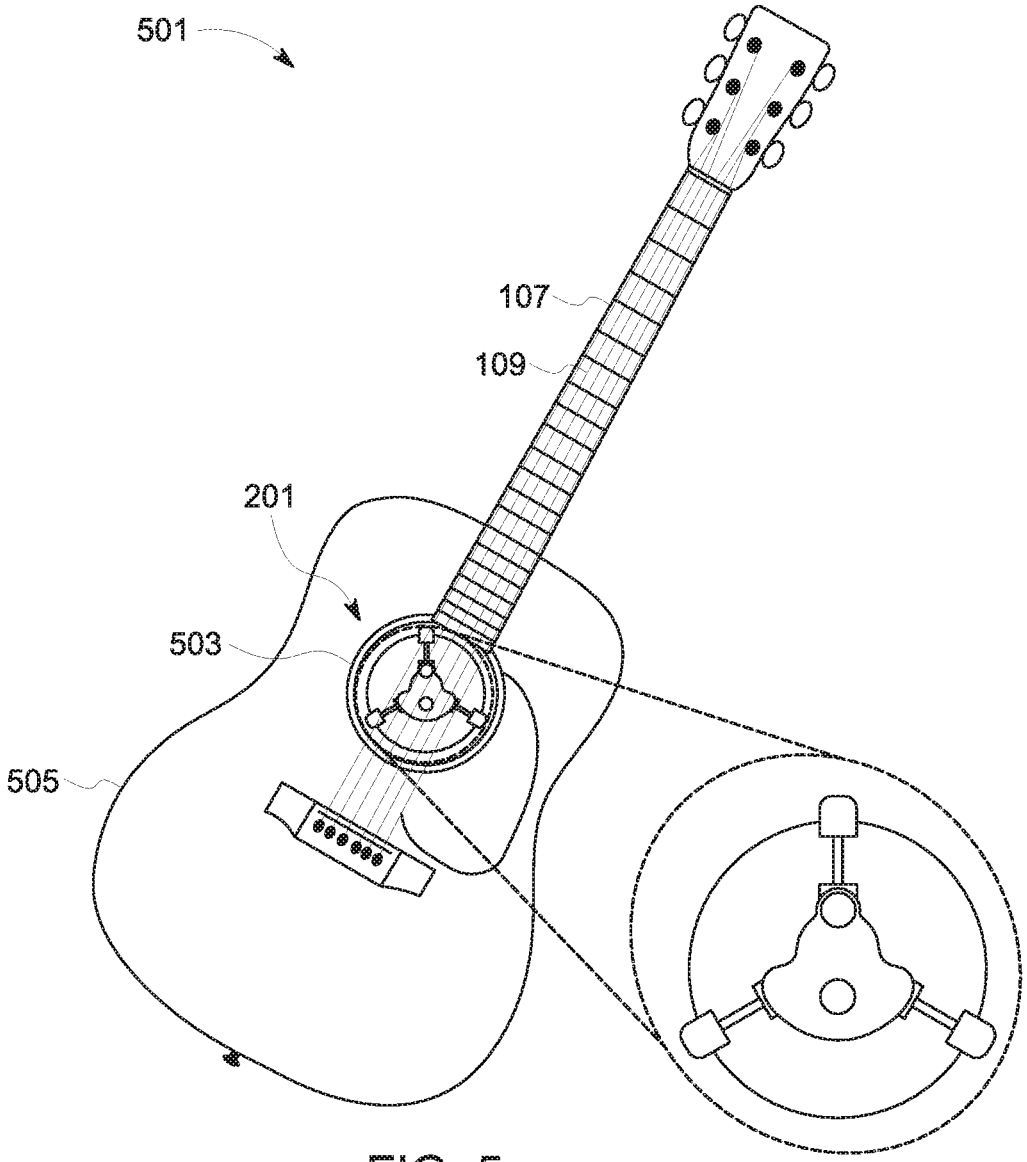
FIG. 5 is a display system with a guitar and the apparatus of FIG. 2.

In the preferred embodiment, each of the plurality of legs includes a shelf 213 configured to engage with an edge of a sound hole of a guitar, as shown in FIG. 5.

Apparatus 201 further includes a top plate 215 that is rotationally connected to the base 209 via a rotation mechanism 301. This allows for the plate 215 to rotate about a central axis. In the preferred embodiment, a weight 217 is used to cause the top plate to always remain in an upright position. As shown, in the preferred embodiment, the weight 217 is a portion of the top plate that is larger than the remainder of the plate, thereby allowing for the portion to always drop to a bottom position.

It should be appreciated that one of the unique features believed characteristic of the present application is the configuration of the apparatus that allows for the top plate to always remain in an upright position. This feature allows for a user to add an image or logo that will then always remain upright. In FIG. 4, an image 401 is shown attached to the top plate for reference. It should be appreciated that the image 401 may be a separate component that is secured to the top plate, or alternatively may be printed directly on the top plate.

In FIG. 5, a front view depicts a display system 501 wherein apparatus 201 is secured within a sound hole 503 of a guitar 505. As shown, even when the guitar is not in an upright position, the top plate 215 remains upright.

Figure 6:
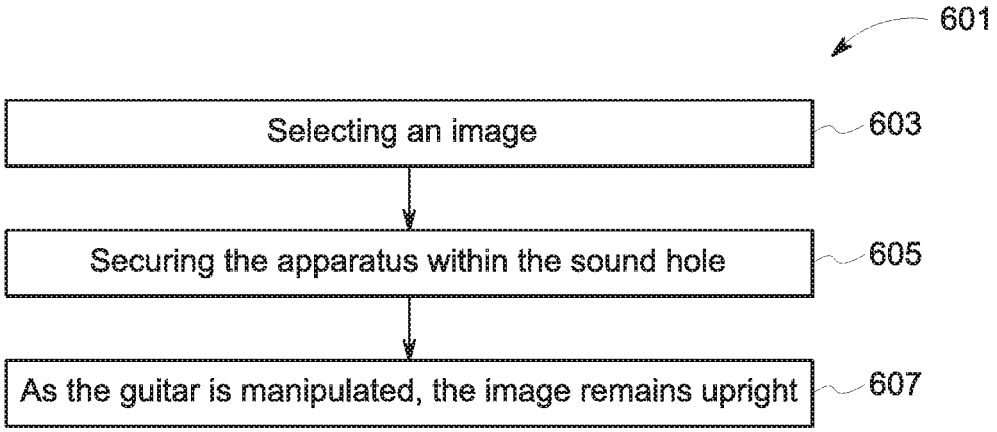
FIG. 6 is a flowchart of a method of use of the system of the present invention.

In FIG. 6, a flowchart 601 depicts a method of use of the system of the present invention. During use, a user will select a desired image, which will be added or pre-incorporated into the display apparatus, as shown with box 603. The user will then proceed to depress the plurality of legs such that the shelf of each leg can engage with an edge of the sound hole, as shown with box 605. As the guitar (or other instrument) is manipulated, the rotation mechanism will ensure that the image remains upright, as shown with box 607.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A display system for use in a sound hole of a guitar, the display system comprising:

a plurality of legs extending outwardly from a central point;

a base connected to the plurality of legs;

a top plate rotationally connected to the base; and a weight incorporated into the top plate to create rotation;

wherein the plurality of legs are configured to engage with the guitar to secure the display system within the sound hole.

2. The system of claim 1, wherein the plurality of legs each comprise:

a shelf configured to engage with an edge of guitar sound hole.

3. The system of claim 1, further comprising:

an image displayed on a top surface of the top plate.

4. A display system for use in a sound hole of a guitar, the display system comprising:

the guitar with the sound hole;

a display apparatus, having:

a plurality of legs extending outwardly from a central point; a base connected to the plurality of legs; and a top plate rotationally connected to the base; and a weight incorporated into the top plate to create rotation;

wherein the plurality of legs are configured to engage with the guitar to secure the display system within the sound hole.

5. The system of claim 4, wherein the plurality of legs each comprise:

a shelf configured to engage with an edge of guitar sound hole.

6. The system of claim 4, further comprising:

an image displayed on a top surface of the top plate.

* * * * *